US006835071B2

(12) United States Patent
Pupkiewicz et al.

(10) Patent No.: US 6,835,071 B2
(45) Date of Patent: Dec. 28, 2004

(54) ELASTOMERIC CONNECTOR INTERCONNECTING FLEXIBLE CIRCUITS AND CIRCUIT BOARD AND METHOD OF MANUFACTURING THE SAME

(75) Inventors: Edward Joseph Pupkiewicz, Norristown, PA (US); Bohdan Petro Wozniak, Warrington, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/908,424

(22) Filed: Jul. 18, 2001

(65) Prior Publication Data

US 2003/0017726 A1 Jan. 23, 2003

(51) Int. Cl.[7] ..... H01R 29/00
(52) U.S. Cl. ..... 439/66; 439/493; 439/83
(58) Field of Search ..... 439/66, 65, 67, 439/77, 91, 493, 83

(56) References Cited

U.S. PATENT DOCUMENTS

| | | | | | |
|---|---|---|---|---|---|
| 3,998,512 | A | * | 12/1976 | Anhalt et al. | 439/65 |
| 4,201,435 | A | * | 5/1980 | Nakamura | 439/91 |
| 4,221,444 | A | * | 9/1980 | Patrick | 439/91 |
| 4,402,562 | A | * | 9/1983 | Sado | 439/91 |
| 4,449,774 | A | * | 5/1984 | Takashi et al. | 439/590 |
| 4,695,258 | A | | 9/1987 | Hanson et al. | 439/67 |
| 4,824,379 | A | * | 4/1989 | Roberts et al. | 439/77 |
| 4,850,883 | A | | 7/1989 | Kabadi | 439/67 |
| 4,859,189 | A | * | 8/1989 | Petersen et al. | 439/66 |
| 4,867,689 | A | * | 9/1989 | Redmond et al. | 439/71 |
| 5,035,628 | A | * | 7/1991 | Casciotti et al. | 439/66 |
| 5,161,981 | A | * | 11/1992 | Deak et al. | 439/66 |
| 5,316,486 | A | * | 5/1994 | Tanaka et al. | 439/67 |
| 5,462,441 | A | | 10/1995 | Renn et al. | 439/67 |
| 5,772,467 | A | * | 6/1998 | Burgess | 439/67 |
| 6,227,901 | B1 | | 5/2001 | Pupkiewicz et al. | 439/500 |

* cited by examiner

*Primary Examiner*—P. Austin Bradley
*Assistant Examiner*—Briggitte R. Hammond

(57) ABSTRACT

A connector assembly is provided that includes a rigid circuit board, a connector base, an elastomeric member, a flex circuit and a cover. The connector assembly is compressively sandwiched together. The cover of the assembly provides the compressive force to ensure that a conductive path is established between conductive pads on the rigid circuit board and conductive pads on the flex circuit. The connector assembly may be manufactured entirely through a Z-axis assembly process. That is, each component of the system may be positioned on top of an adjacent component. A method of manufacturing a connector assembly is provided comprising the step of orienting a first circuit having conductive pads at a connector assembly position within a first plane. The method also includes the steps of conveying a connector base along a mounting axis perpendicular to the first plane to a surface mounted position on a first side of the first circuit and conveying an elastomeric member along the mounting axis to a cavity formed in the base in order that a first conductive interface of the elastomeric member electrically engages the first circuit. The method also includes the step of securing a second circuit to the connector base such that the second circuit is in electrical contact with a second conductive interface of the elastomeric member.

24 Claims, 3 Drawing Sheets

ELASTOMERIC CONNECTOR INTERCONNECTING FLEXIBLE CIRCUITS AND CIRCUIT BOARD AND METHOD OF MANUFACTURING THE SAME

BACKGROUND OF THE INVENTION

Certain embodiments of the present invention generally relate to connector assemblies and more particularly to an elastomeric connector for electrically connecting flexible circuit boards to printed circuit boards. Other embodiments of the present invention relate to methods of manufacturing an elastomeric connector.

Flexible circuits, or flex circuits, are used with various electronic and electrical devices. In many applications, flex circuits are used in conjunction with rigid circuit boards, such as printed circuit boards. Because flex circuits and rigid circuits are often used together, connectors are used to electrically connect the flex circuits to the rigid circuits.

One way of connecting a flex circuit to a rigid circuit is through an elastomeric connector. Typically, an elastomeric connector includes alternating columns or slices formed of conductive and non-conductive layers, such as formed from silicon rubber. The conductive and non-conductive layers are oriented with ends of each layer engaging conductive parts on the flex circuit and on the rigid circuit. Typically, the elastomeric connector is secured to the flex circuit and the rigid circuit through fasteners such as screws. Throughholes are typically drilled through printed circuit boards to receive the screws. However, the use of screws with an elastomeric connector may preclude the use of the elastomeric connector with various types of electronic equipment. For example, many cell phones today are compact enough to fit in a coat pocket. The use of bulky fasteners, such as screws, typically increases the size of a cell phone. That is, cell phones are designed bigger to accommodate the size of the interior components of the cell phone, where the component size is partially based on the size of connections between components. However, increasing the size of cell phones may discourage consumers from purchasing such phones when smaller, more compact cell phones are available.

As an alternative to screws, some flex circuits are fastened to printed circuit boards through zero insertion force ("ZIF") connectors. ZIF connectors are a compressive connector. That is, no screws are used to fasten the components of the ZIF connector, the flex circuit and the printed circuit board together. Rather, the flex circuit is slid inside a ZIF connector that was previously soldered to the printed circuit board. After the flex circuit is slid inside the ZIF connector, the flex circuit, the printed circuit board and the ZIF connector are clamped together. ZIF connectors include small mechanical pins that are used to contact conductive pads on the flex circuit and the printed circuit board. The small pins on the ZIF connector are fragile and may be easily damaged.

ZIF connectors may also cause downtime in the assembly process. For example, if the flex circuit is improperly aligned when the top lid of the ZIF connector is clamped down, a poor connection may result between the flex circuit and the printed circuit board. The poor connection may cause shorting within the system utilizing the flex circuit and the printed circuit board. Additionally, the flex circuit may become dislodged during operation of the system. For example, a flex circuit used within a cell phone may become dislodged if the cell phone is dropped. Some systems include an additional structure that applies pressure on the top of the ZIF connector to decrease the chances of the ZIF connector opening and releasing the flex circuit. The additional force placed on the top of the ZIF connector, however, adds manufacturing time and cost to the system. Additionally, the additional force may damage the small pins of the ZIF connector.

Thus, a need remains for an improved connector and method of connecting a printed circuit board to a flex circuit through an elastomeric connector. Additionally, a need remains for an easier method of manufacturing a connector assembly that uses an elastomeric connector. Further, a need remains for a more robust connector assembly, and for a connector assembly that may be easily changed and upgraded within an electronic or electrical system.

SUMMARY OF THE INVENTION

Certain embodiments of the present invention provide a connector assembly for interconnecting a flexible circuit to a circuit board. Additionally, certain embodiments of the present invention provide a connector assembly for interconnecting a flex circuit to another flex circuit or a printed circuit board to another circuit board. The connector assembly includes a circuit board, a base, an elastomeric member, a flex circuit and a cover. The circuit board includes an array of board conductive pads on a first surface of the circuit board. The first surface of the circuit board includes anchoring areas proximate the board conductive pads.

The base includes a bottom surface that is secured to the anchoring areas through tabs on the base. The tabs may be reflow soldered to the anchoring areas. One embodiment of the present invention includes four anchoring areas and four tabs. The base also includes a channel extending through the length of the base. The channel is aligned with and exposes the board conductive pads on the first surface of the circuit board. The base may also include a plurality of ribs located about walls defining the channel. The ribs frictionally engage the elastomeric member to assist in retaining the elastomeric member within the base. The base also includes at least one alignment pin located on the top surface thereof. The flex circuit includes at least one hole for receipt of one alignment pin.

The elastomeric member includes an array of conductive and insulative materials arranged along a longitudinal axis of the member and first and second conductive interfaces electrically communicating with one another. The array of conductive and insulative materials is sandwiched together. The elastomeric member also includes insulative sides formed along opposite sides of the array of conductive and insulative materials in a transverse direction. The elastomeric member substantially conforms to the shape of the channel. The channel receives the elastomeric member. The first conductive interface engages the board conductive pads.

The flex circuit includes a flex first surface having an array of flex conductive pads. The flex first surface is secured to the base such that the flex conductive pads are oriented to align with and contact the second conductive interface. The circuit board and the flex circuit are oriented relative to one another such that the board conductive pads and the flex conductive pads align on top of one another and compressively sandwich the elastomeric member therebetween.

The cover is removably secured to the base. The cover compressively engages a second surface of the flex circuit to bias the flex conductive pads and the board conductive pads against the elastomeric member. The cover may include latches on opposite ends thereof that snapably engage notches formed in opposite ends of the base. The cover and the base cooperate to compress the flex circuit against the elastomeric member.

The connector assembly may be fully assembled through a Z-axis assembly process. That is, each component of the assembly is positioned on top of an adjacent component. The parts of the components do not have to be slid in from a horizontal axis during assembly.

Another embodiment of the present invention provides a method of manufacturing a connector assembly comprising the step of orienting a first circuit having conductive pads at a connector assembly position within a first plane. The method also includes the steps of conveying a connector base along a mounting axis perpendicular to the first plane to a surface mounted position on a first side of the first circuit and conveying an elastomeric member along the mounting axis to a cavity formed in the base in order that a first conductive interface of the elastomeric member electrically engages the first circuit. The method also includes the step of securing a second circuit to the connector base such that the second circuit is in electrical contact with a second conductive interface of the elastomeric member. One of the first and second circuits is a flex circuit. The other circuit is a printed circuit board. The method also includes the step of compressively engaging the elastomeric member and one of the first and second circuits with one another. Further, the cover is conveyed along the mounting axis and snapably engages latches on the cover with notches formed in opposite ends of the base. Tabs on the connector base are soldered to solder pads on one of the first and second circuits.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are present preferred. It should be understood, however, that the present invention is not limited to the precise arrangements and instrumentality shown in the attached drawings.

DETAILED DESCRIPTION OF THE DRAWINGS

Figure 1:
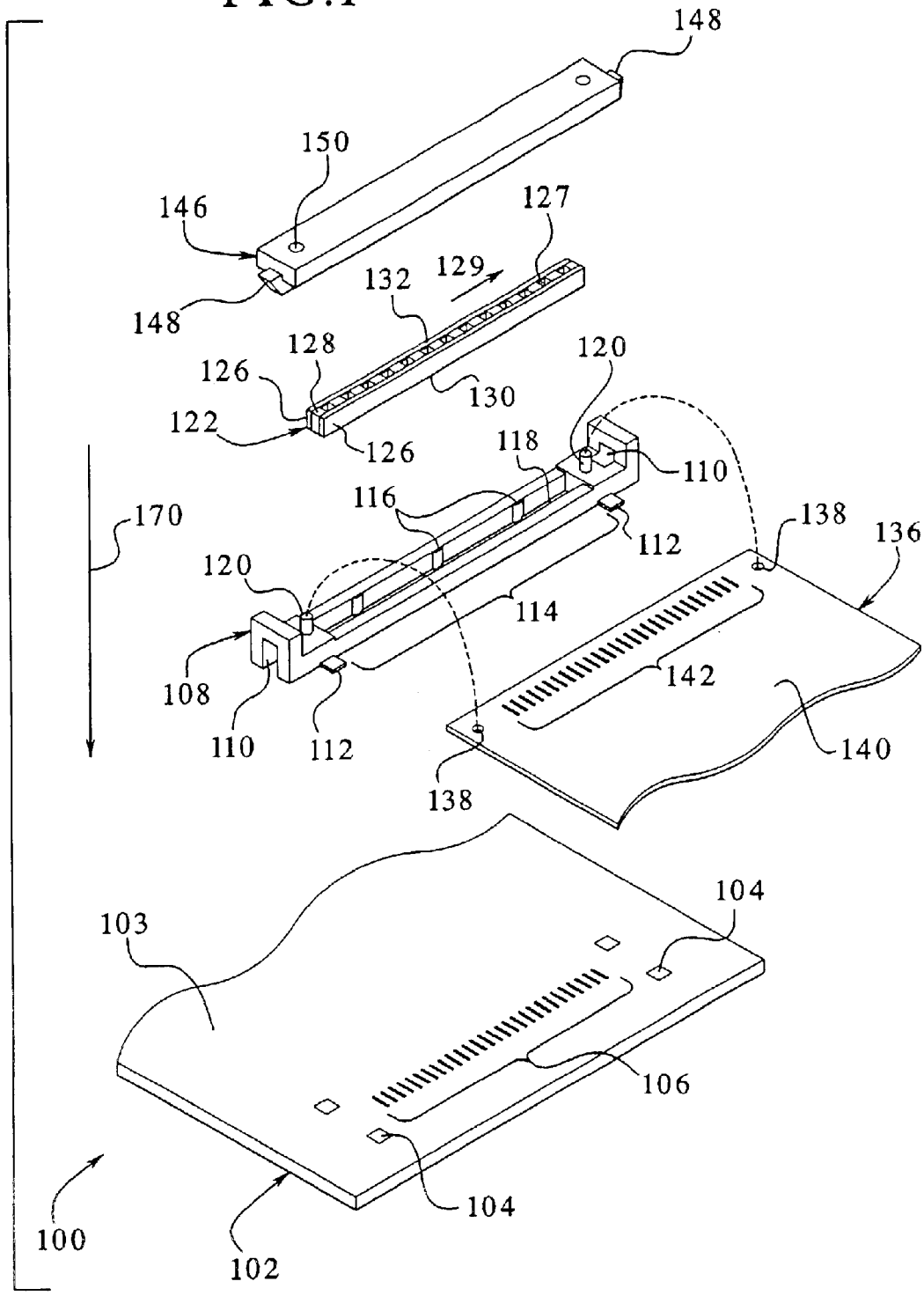
FIG. 1 illustrates an exploded view of a surface mounted connector assembly formed in accordance with an embodiment of the present invention.

FIG. 1 illustrates an exploded view of a surface mounted connector assembly 100 formed in accordance with an embodiment of the present invention. The connector assembly 100 includes a circuit board, such as a printed circuit board 102, a connector base 108, an elastomeric member 122, a flex circuit 136 and a cover 146. The circuit board 102 includes a top surface 103 having anchoring areas 104 and an array of board conductive pads 106. The elastomeric member 122 includes insulated sides 126, formed along opposite sides of a series of columns or slices of conductive elastomeric material 127 and insulative elastomeric material 128. The elastomeric member 122 also includes a bottom conductive interface 130 and a top conductive interface 132 in electrical communication with one another. The flex circuit 136 includes alignment holes 138, a bottom surface 140 with flex conductive pads 142 provided thereon The columns or slices of conductive and non-conductive elastomeric material 127 and 128 are alternately stacked adjacent one another along a longitudinal direction (denoted by arrow 129). Each individual column or slice of conductive and non-conductive elastomeric material 127 and 128 is formed with a thickness in a transverse direction that is less than a thickness of individual board and flex conductive pads 106 and 142 in order that multiple slices of conductive elastomeric material 127 overlap one board conductive pad 106 and one flex conductive pad 142. The thickness of slices of conductive elastomeric material 127 is thin enough such that no single slice of conductive elastomeric material 127 touches two adjacent flex conductive pads on the array 142 nor two adjacent board conductive pads on the array 106.

Figure 2:
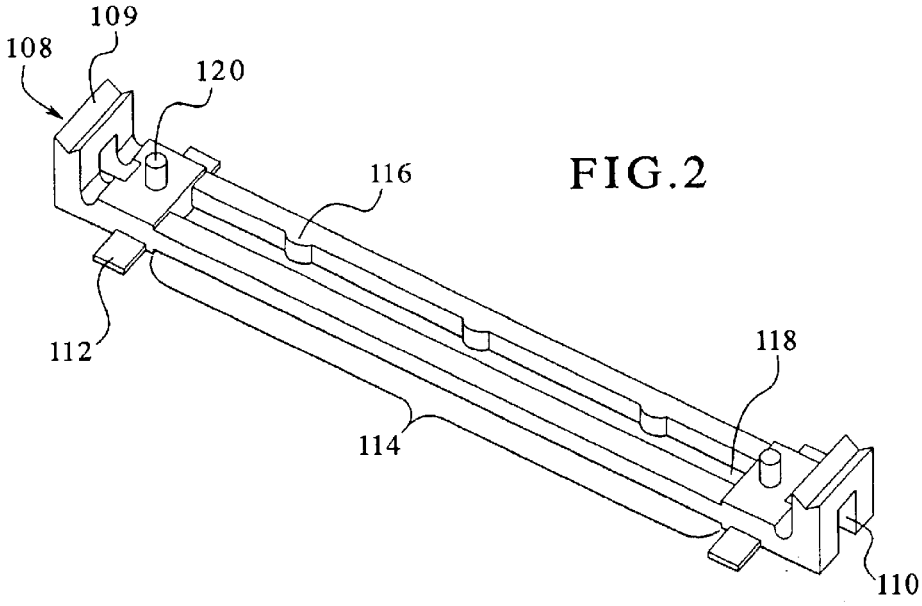
FIG. 2 illustrates a base formed in accordance with an embodiment of the present invention.
Figure 4:
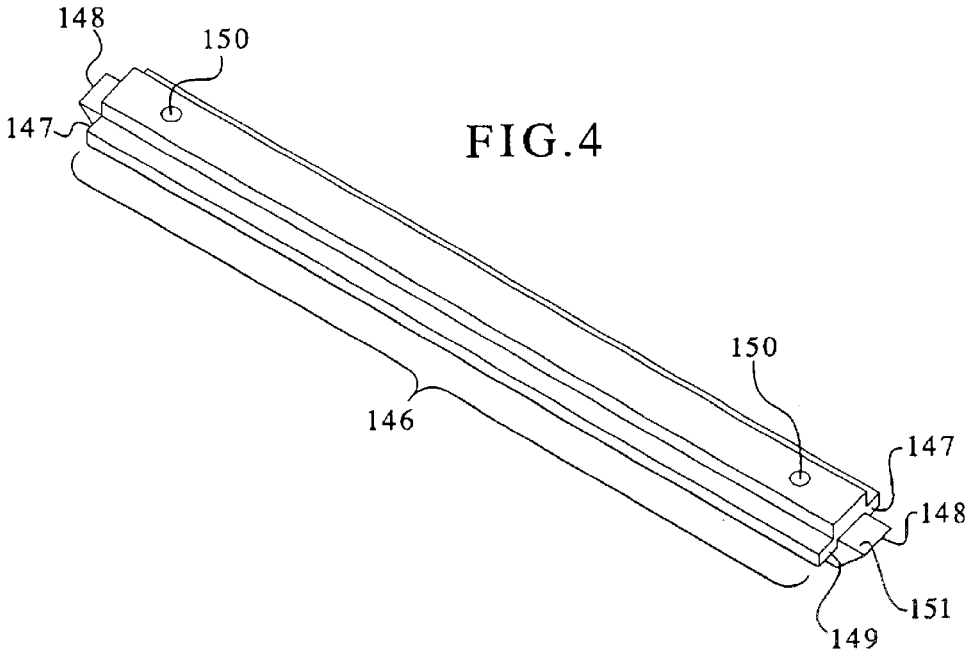
FIG. 4 illustrates a cover formed in accordance with an embodiment of the present invention.

FIGS. 2 and 4 illustrate the base 108 and the cover 146, respectively, formed in accordance with an embodiment of the present invention. The base 108 includes notches 110 located on opposite vertical end walls 109 of the base 108. The base 108 also includes tabs 112 formed along either side of the base 108 and across from one another. Clearance area 114 is formed on a bottom surface of the base 108 bounded by the tabs 112. A channel 118 is formed within the base 108 extending along a longitude of the base. The channel 118 is shaped to receive the elastomeric member 122. Ribs 116 are positioned at points along the walls that define the channel 118. The ribs 116 frictionally engage the elastomeric member 122. Alignment pins 120 are formed on the top surface of the base 108 and project upward.

The cover 146 (FIG. 4) is rectangularly shaped with latches 148 on opposite ends 147 thereof. The latches 148 are formed with ramped surfaces 149 and a locking top surface 151. The ramped surfaces 149 slidably engage and bias outward, the vertical end walls 109 until the locking top surface 151 snaps into the notches 110. The cover 145 also includes alignment holes 150 located to align with the alignment pins 120 on the base 108.

The connector assembly 100 is assembled without bulky fasteners, such as screws, and/or holes drilled in the circuit board 102. The base 108 is positioned on the top surface 103 of the circuit board 102 such that the tabs 112 align with the anchoring areas 104. The tabs 112 may be insert molded within the base 108. Alternatively, the tabs 112 may be directly bonded to the bottom surface of the base 108 or stitched into the base 108. In one embodiment of the present invention, the anchoring areas 104 may be provided during manufacturing with reflow solder paste. The tabs 112 may be soldered to the anchoring areas 104. Alternatively, the tabs 112 may be fastened to the anchoring areas through glue or another adhesive material.

The clearance area 114 constitutes a notch in the bottom of the base 108 slightly higher than the tabs 112. The clearance area 114 allows the tabs 112 to be securely positioned on the anchor areas 104, and lateral positions of the base 108 extending between the tops 112 to be securely positioned on the circuit board 102, thereby providing even contact between the bottom surface of the base 108 with the board conductive pads 106 while simultaneously providing even contact between the tabs 112 and the anchoring areas 104. Alternatively, the base 108 may not include a clearance area 114, in which case the anchoring areas 104 may protrude outwardly from the surface of the circuit board 102.

Once the base 108 is secured to the circuit board 102, the channel 118 aligns with and exposes the board conductive pads 106. The elastomeric member 122 is vertically inserted downward into the channel 118. The ribs 116 frictionally engage the elastomeric member 122 and assist in retaining the elastomeric member 122 in the channel 118. The bottom conductive interface 130 of the elastomeric member 122 contacts the board conductive pads 106 of the circuit board 102.

The flex circuit 136 is positioned on top of the base 108 and the elastomeric member 122. In FIG. 1, the flex circuit 136 is inverted in order to clearly show the flex conductive pads 142. The dashed arcs extending from the alignment holes 138 to the alignment pins 120 show how the flex circuit is positioned (or flipped, as shown in FIG. 1) onto the base 108. The alignment holes 138 receive and retain the alignment pins 120. The flex conductive pads 142 contact the top conductive interface 132 of the elastomeric member 122. In order to maintain contact between the flex conductive pads 142 and the top conductive interface 132, and the bottom conductive interface 130 and the board conductive pads 106, the connector assembly 100 compresses the components 142, 132, 130 and 106 together. The cover 146 provides compressive force within the connector assembly 100.

The cover 146 may be made of plastic or metal. Alternatively, the cover 146 may be made of plastic with a metal strip insert molded within the cover 146 to provide additional rigidity. The cover 150 is positioned on top of the base 108, thereby sandwiching the flex circuit 136, the elastomeric member 122, the base 108 and the circuit board 102 together. The latches 148 of the cover 146 are received by the notches 110 of the base 108. The latches 148 are snapped onto to the notches 110. Alternatively, the cover 146 may include notches and the base 108 may include latches.

The alignment holes 150 of the cover 146 receive and retain the alignment pins 120 of the base 108, thereby ensuring proper alignment of the cover 146 on the base 108. After the cover 150 is snapably positioned on to the base 108, the components of the connector assembly 100 are compressively sandwiched together. The compressive sandwiching of the components of the connector assembly 100 provides an electrical path from the board conductive pads 106 to the bottom conductive interface 130 from the bottom conductive interface 130 to the top conductive interface 132 and from the top conductive interface 132 to the flex conductive pads 142. Thus, an electrical path is established in the connector assembly 100 without the need for bulky fasteners, such as screws. Because the cover 146 is snapped onto the base 108, the cover 146 may also be easily removed from the base 108 and re-connected repeatedly. The elastomeric member 122 within the connector assembly 100 may be changed or upgraded, without concern for fragile pins on the elastomeric member.

Certain embodiments of the present invention provide a simple process of manufacturing the connector assembly 100. The manufacturing process is simple because the entire connector assembly 100 may be assembled in the Z-axis, that is, vertically. In Z-axis assembly, each component of the connector assembly 100 may be positioned on top of its adjacent component, instead of inserting components into the connector assembly 100 horizontally. The z-axis assembly allows automated/robotic assembly machinery to assemble the connector assembly 100.

Figure 3:
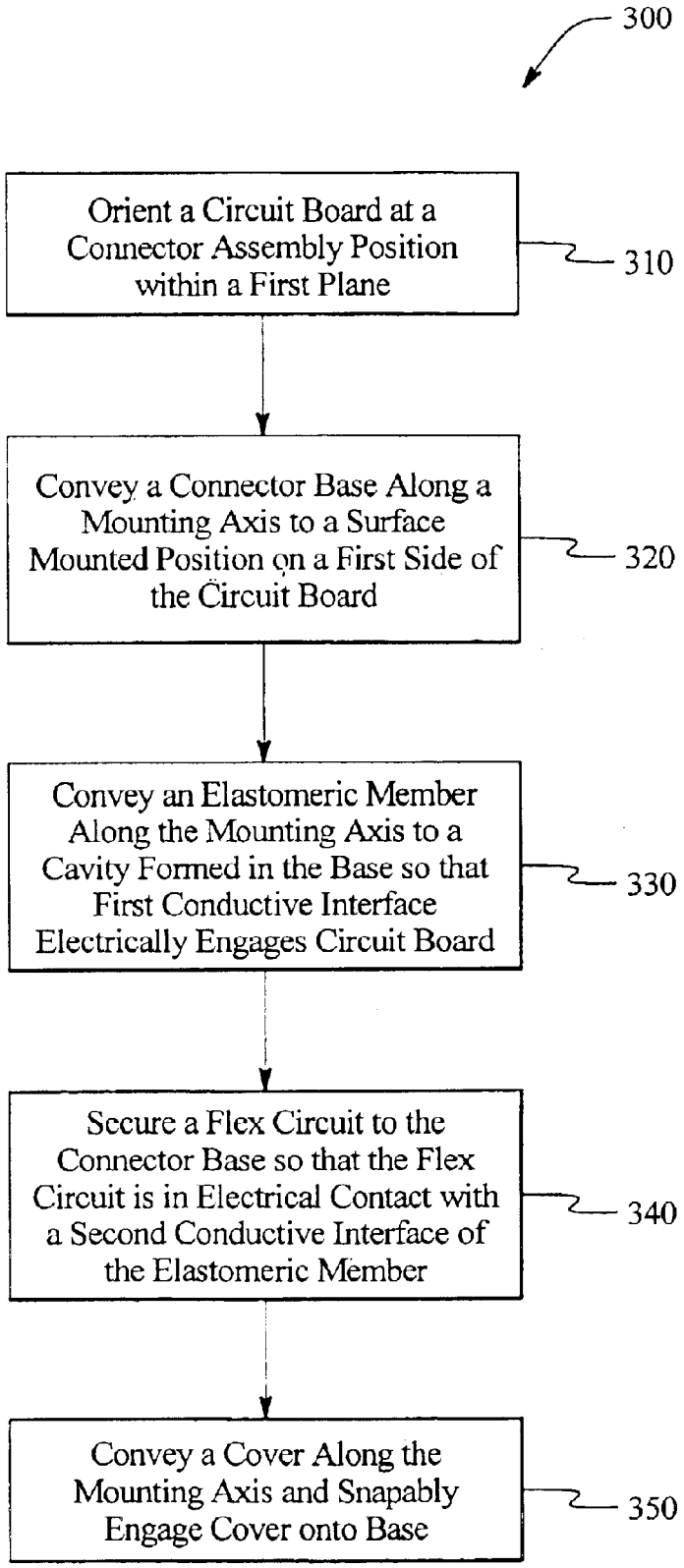
FIG. 3 is an assembly flow chart according to an embodiment of the present invention.

FIG. 3 is an assembly flow chart 300 according to an embodiment of the present invention. At step 310, the circuit board 102 is oriented at a connector assembly position within a first plane (e.g., the plane holding the circuit board 102 in FIG. 1). Next, at step 320, the connector base 108 is conveyed along a mounting axis to a surface mounted position on the top surface 103 of the circuit board 102. The mounting axis 170 (shown by the arrow in FIG. 1) is perpendicular to the first plane. At step 330, the elastomeric member 122 is conveyed along the mounting axis 170 to the channel 118 formed in the base 108. The elastomeric member 122 is positioned such that the bottom conductive interface 130 electrically engages the board conductive pads 106 of the circuit board 102. At step 340, the flex circuit 136 is conveyed along the mounting axis 170 and secured to the connector base 108 so that the flex conductive pads 142 are in electrical contact with the top conductive interface 132. At step 350, the cover 146 is conveyed along the mounting axis 170 until it is positioned on top of the elastomeric member 122 of the connector assembly 100. The cover 146 is pressed downward and snapably engages the base 108 thereby compressively sandwiching the flex circuit 136, the elastomeric member 122, and the base 108 together. Consequently, an electrical path is established from the board conductive pads 106 through the elastomeric member 122 to the flex conductive pads 142.

Embodiments of the present invention provide an improved apparatus and method of connecting a rigid circuit to a flex circuit through an elastomeric connector. Additionally, embodiments of the present invention provide an easier method of manufacturing such a connector because the connector assembly may be manufactured entirely in the Z-axis. Further, embodiments of the present invention provide a more robust connector assembly. Embodiments of the present invention also provide a connector assembly that may be easily changed and upgraded within an electronic or electrical system. Additionally, embodiments of the present invention provide an elastomeric connector assembly that is durable and reliable over time due to the alignment of the boards, and the safe level of compressive force holding the assembly together. That is, the compressive force holding the assembly together does not damage components of the assembly.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features coming within the scope of the invention.

What is claimed is:

1. A connector assembly for interconnecting a flexible circuit to a circuit board comprising:

a circuit board having an array of board conductive pads on a first surface of said circuit board;

anchoring areas on said first surface of said circuit board proximate said board conductive pads;

a base including:

tabs that are adhesively surface mounted on said anchoring areas on said first surface of said circuit board, thereby securing said base to said circuit board without screws; and a channel extending through said base, said channel being aligned with and exposing said board conductive pads on said first surface of said circuit board;

an elastomeric member substantially conforming to a shape of said channel, said channel receiving said elastomeric member, said elastomeric member having first and second conductive interfaces electrically communicating with one another, said first conductive interface engaging said board conductive pads; and a flex circuit having a first flex surface having an array of flex conductive pads, said first flex surface being secured to said base such that said flex conductive pads are oriented to align with and contact said second conductive interface.

2. The connector assembly of claim 1 wherein said elastomeric member includes:

an array of slices of conductive and insulative materials arranged along a longitudinal axis of the elastomeric member, wherein said array of conductive and insulative materials are sandwiched together; and insulative sides formed along opposite transverse sides of said array of conductive and insulative materials.

3. Connector assembly of claim 1 wherein said circuit board and said flex circuit are oriented relative to one another such that said board conductive pads and said flex conductive pads align with one another and compressively sandwich said elastomeric member therebetween.

4. The connector assembly of claim 1 further comprising a cover removably secured to said base, said cover compressively engaging a second surface of said flex circuit to bias said flex conductive pads against said elastomeric member and to bias said elastomeric member against said board conductive pads.

5. The connector assembly of claim 1 further comprising a cover having latches on opposite ends thereof that snapably engage notches formed in opposite ends of said base, said cover and said base cooperating to compress said flex circuit against said elastomeric member.

6. The connector assembly of claim 1 wherein the base includes a plurality of ribs located about walls defining said channel, said ribs frictionally engaging said elastomeric member to assist in retaining said elastomeric member within said base.

7. The connector assembly of claim 1 wherein said base includes at least one alignment pin located on a top surface of said base, said flex circuit having a hole receiving said at least one alignment pin.

8. The connector assembly of claim 1 wherein said tabs are secured to said anchoring areas of said circuit board.

9. The connector assembly of claim 1 wherein said tabs are located at opposite ends of said base, said tabs being secured to said anchoring areas of said circuit board.

10. The connector assembly of claim 1 wherein said tab are secured to said anchoring areas through a reflow solder paste.

11. The connector assembly of claim 1 wherein one of glue and solder is used to adhesively surface mount said tabs to said anchoring areas.

12. A connector assembly adapted to compressively engage first and second circuits, the first circuit having first conductive elements and the second circuit having second conductive elements, said connector assembly comprising:

a base having a bottom that is surface mounted to said second circuit, said base having a channel extending therethrough;

an elastomeric member substantially conforming to a shape of said channel, said channel receiving said elastomeric member, said elastomeric member having first and second conductive surfaces electrically communicating with one another and engaging the first and second conductive elements, said base including a plurality of ribs located about walls defining said channel, said ribs frictionally engaging said elastomeric member to assist in retaining said elastomeric member within said base; and a cover snapably secured to said base to compress the first circuit between said cover and a top surface of said base.

13. The connector assembly of claim 12 wherein said first and second circuits include arrays of conductive pads.

14. The connector assembly of claim 12 wherein at least one circuit is a flex circuit, and wherein at least one circuit is a circuit board.

15. The connector assembly of claim 12 wherein both circuits are flex circuits.

16. The connector assembly of claim 12 wherein said base includes tabs surface mounted to one of said first and second circuits.

17. The connector assembly of claim 12 wherein said elastomeric member includes:

an array of conductive and insulative materials arranged along a longitudinal axis of the elastomeric member, wherein said array of conductive and insulative materials are sandwiched together; and insulative sides formed along opposite transverse sides of said array of conductive and insulative materials.

18. The connector assembly of claim 12 wherein said cover includes latches on opposite ends thereof that snapably engage notches formed in opposite ends of said base.

19. The connector assembly of claim 12 wherein said base includes at least one alignment pin located on a top surface thereof, and wherein one of said first and second circuits includes a hole receiving said at least one alignment pin.

20. The connector assembly of claim 12 wherein said base is adhesively mounted to said second circuit with one of glue and solder.

21. The connector assembly of claim 12 wherein said first and second circuits are secured to said base without screws.

22. A connector assembly for interconnecting a flexible circuit to a circuit board comprising:

a circuit board having an array of board conductive pads on a first surface of said circuit board;

anchoring areas on said first surface of said circuit board proximate said board conductive pads;

a base including:

at least one alignment pin located on a top surface of said base;

a bottom surface that is adhesively secured to said anchoring areas on said first surface of said circuit board, thereby securing said base to said circuit board without screws; and a channel extending through said base, said channel being aligned with and exposing said board conductive pads on said first surface of said circuit board;

an elastomeric member substantially conforming to a shape of said channel, said channel receiving said elastomeric member, said elastomeric member having first and second conductive interfaces electrically communicating with one another, said first conductive interface engaging said board conductive pads, said elastomeric member including an array of conductive and insulative materials arranged along a longitudinal axis of the elastomeric member; and insulative sides formed along opposite transverse sides of said array of conductive and insulative materials; and a flex circuit having an alignment hole and a first flex surface having an array of flex conductive pads, said first flex surface being secured to said base with said alignment pin received in said alignment hole such that said flex conductive pads are oriented to align with and contact said second conductive interface.

23. A connector assembly adapted to compressively engage first and second circuits, the first circuit having first conductive elements and the second circuit having second conductive elements, said connector assembly comprising:

a base positionable between the first and second circuit, said base having a channel extending therethrough;

an elastomeric member substantially conforming to a shape of said channel, said channel receiving said elastomeric member, said elastomeric member having first and second conductive surfaces electrically communicating with one another through said elastomeric member and adapted to engage the first and second conductive elements, said elastomeric member including an array of multiple slices of conductive and insulative materials arranged along a longitudinal axis of the elastomeric member, and insulative sides formed along opposite transverse sides of said array of multiple slices of conductive and insulative materials, said base including a plurality of ribs located about walls defining said channel, said ribs frictionally engaging said elastomeric member to assist in retaining said elastomeric member within said base; and a cover removably secured to said base, said cover and said base forming a compressive interface between the first and second conductive elements and said elastomeric member.

24. A connector assembly comprising:

a circuit board comprising pads and anchoring areas;

an elastomeric member comprising an array of alternately stacked conductive materials and insulative materials, and insulative sides formed along opposite transverse sides of said stacked conductive materials and insulative materials;

a base having a channel for said elastomeric member, said base including a plurality of ribs located about walls defining said channel, said ribs frictionally engaging said elastomeric member to assist in retaining said elastomeric member within said base; and a flex circuit having conductive pads.

* * * * *